United States Patent [19]

Caferro

[11] Patent Number: 5,008,791

[45] Date of Patent: Apr. 16, 1991

[54] LOW DIRECT GLARE AND WALL WASH PARABOLIC LIGHTING GRID

[76] Inventor: Ronald N. Caferro, 1520 Rockwood Blvd., Spokane, Wash. 99203

[21] Appl. No.: 555,250

[22] Filed: Jul. 19, 1990

[51] Int. Cl.[5] ..... F21V 11/06

[52] U.S. Cl. ..... 362/290; 362/342; 362/354

[58] Field of Search ..... 362/260, 267, 290, 291, 362/292, 342, 354

[56] References Cited

U.S. PATENT DOCUMENTS

| | | | |
|---|---|---|---|
| 2,971,083 | 11/1961 | Phillips et al. | 362/342 |
| 3,169,710 | 2/1965 | Lipscomb | 362/292 |
| 3,582,642 | 6/1971 | Johansson | 362/342 |
| 4,042,817 | 8/1977 | McNamara, Jr. | 362/290 |
| 4,222,094 | 9/1980 | Wolar | 362/279 |
| 4,368,504 | 1/1983 | Sato et al. | 362/33 |
| 4,384,318 | 5/1983 | Reibling | 362/216 |
| 4,621,309 | 11/1986 | Grawe et al. | 362/342 |
| 4,780,800 | 10/1988 | Mullins | 362/290 |
| 4,896,656 | 1/1990 | Johnson | 362/291 |

OTHER PUBLICATIONS

Kingston Industries Corporation Advertisement.

*Primary Examiner*—Ira S. Lazarus
*Assistant Examiner*—Richard R. Cole
*Attorney, Agent, or Firm*—Wells, St. John & Roberts

[57] ABSTRACT

A lighting system for room lighting includes a light grid comprised of intersecting first and second sets of parallel elongated parabolic louvers. The louvers of at least one of the first or second sets are angularly oriented to nadir and spaced apart to confine light passing downwardly therethrough to an asymmetrical candlepower distribution curve. One quadrant of the curve, termed a "wall washing quadrant" is on one side of the curve and a "low direct glare quadrant" is oriented to an opposite side of the curve. The light and light grid are placed adjacent the wall such that the wall washing quadrant is oriented toward the wall to illuminate the wall and the low direct glare distribution quadrant is oriented toward the interior of the room. The wall washing quadrant eliminates the "cave effect" at the juncture of the adjacent wall and the ceiling while the low direct glare quadrant provides desired illumination directed into the adjacent room. Variations of the grid arrangement allows for uniform lighting of corners as well as end and side walls within a room.

15 Claims, 6 Drawing Sheets

Fig 1
PRIOR ART
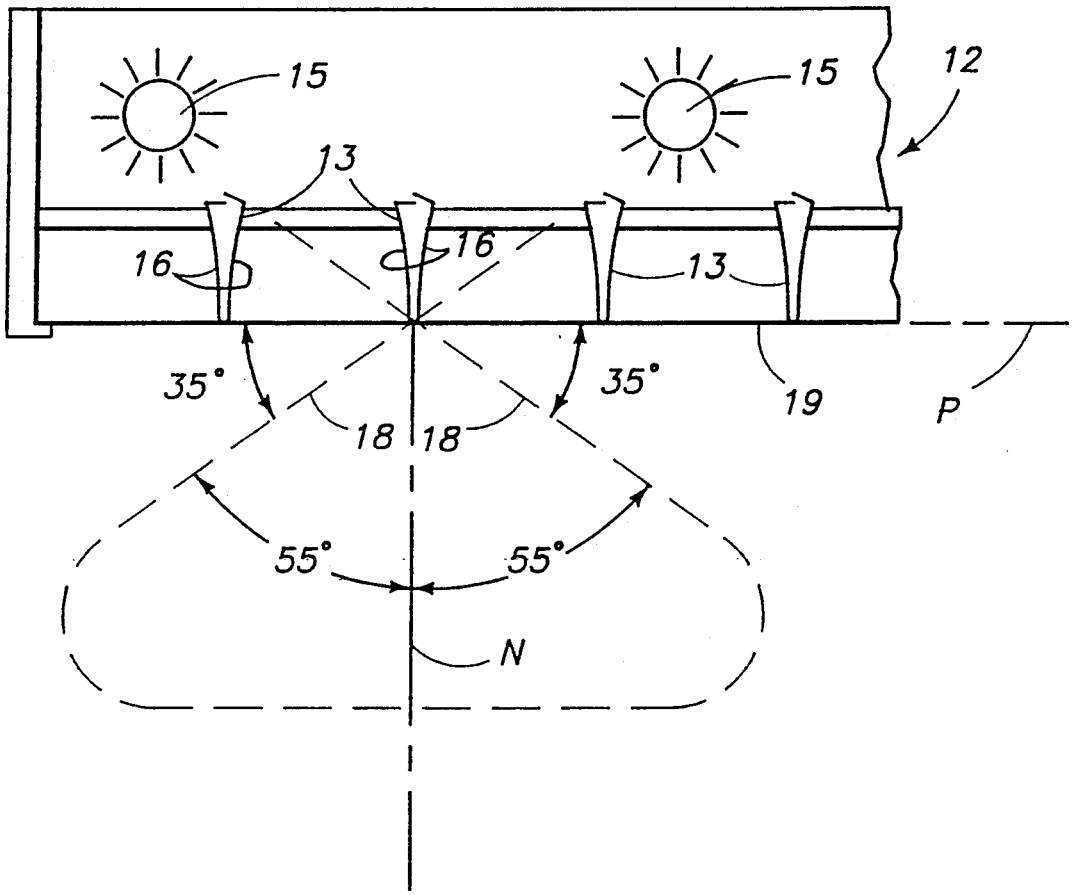
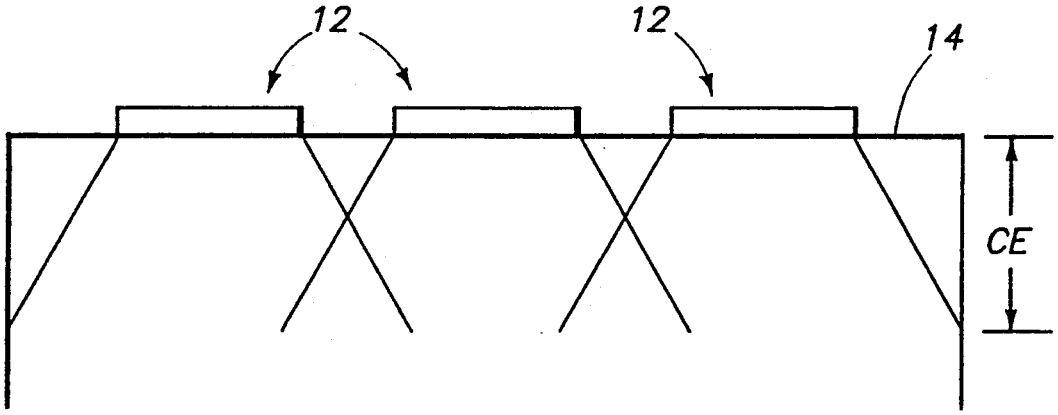
Fig 2
PRIOR ART

LOW DIRECT GLARE AND WALL WASH PARABOLIC LIGHTING GRID

TECHNICAL FIELD

The present invention relates to ceiling lighting for structures and more particularly to a lighting system with a parabolic lighting grid that provides both low direct glare and "wall wash" light distribution curves to maximize lighting efficiency and eliminate the "cave effect " along walls adjacent to the grid.

BACKGROUND OF THE INVENTION

Modern office lighting has changed primarily because of the advent of VDT (visual display terminals) screens and to some degree because of concerns with direct glare which causes discomfort to an occupant at normal viewing angles. Undirected lighting can cause a reflection and glare on VDT screens. The reflection causes a reduction in the readability of the screen and eye strain results.

Research has shown that if the candlepower distribution of a luminaire is limited to an approximate 55° cone around nadir, reflections on the VDT screens are eliminated and the direct glare is reduced or eliminated as well.

Low brightness louver grids have been developed to control the candlepower distribution curve into an optimal "low direct glare " cone configuration. U.S. Pat. No. 2,971,083 to E. R. Phillips et al. discloses a low brightness louver in which individual intersecting louvers are spaced apart and provided with parabolic surfaces for confining light to a prescribed normal symmetrical candlepower distribution curve. This type of lighting grid has been very successful in reducing the reflection in VDT screens and in elimination of glare. However, a new problem called the "cave effects" has resulted from the use of such grids. The cave effect is the result of no direct light applied to upper portions of walls adjacent to the luminaire because of the severe cut off of light in the luminaire. Thus, an area of low illumination or shadow appears at the upper wall surface adjacent the juncture of the wall and ceiling. Directional lighting gas been used to eliminate the cave effect. However, directional lighting requires additional wattage and the overall efficiency of the lighting system dimishes. Due to the ever increasing need to conserve enrgy, codes and legislation have been introduced to minimize the lighting wattage per square foot of room space, especially in commercial construction.

Kingston Industries Corporation of Liberty, New York has developed a "Kinglux Directional Louver" arrangement for directing light in a manner to substantially reduce or eliminate the cave effect. The louvers are spaced and shaped to concentrate light in a particular direction and therefore utilize wattage only to illuminate the shaded areas otherwise produced by the adjacent low glare parabolic fixtures. Such directional lighting to overcome the cave effect does reduce or eliminate that particualr problem but is not conducive to minimal operating lighting requirements of a structure.

U.S. Pat. No. 4,222,094 to Wolar discloses a light distribution fixture in which a group of nine sets of different angularly oriented louvers are provided to attain varying light distribution characteristics. In variations, several of the louvers are angularly adjustable to provide varied distribution effects. This apparatus does not disclose the use of parabolic louvers and so light emitted through the louver sections is diffused even with the particular angular orientation of the louvers or veins. This results in relatively uncontrolled light distribution and resutling inefficiency. Futhermore, the structure is relatively complex.

A quasi-directional monosymmetrical lighting system is disclosed in the McNamara U.S. Pat. No. 4,042,817 . This patent discloses a directional ceiling mounted fixture which is used to provide indirect bounce lighting from wall structures. Angularly oriented flat louvers are used to directionally orient the light, along with an internal parabolic reflector. The angularly oriented light is arranged within the room to reflect from wall surfaces, however, the angle is such that the light concentration is downward from the juncture of the wall and ceiling. The device is therefore likely to produce the "cave effect" when in operation.

U.S. Pat. No. 4,384,318 to Reibling discloses a task light in which a florescent tube is mounted above spaced, angularly oriented flat louvers. The louvers are angled at approximately 30° to the plane of the light. However, due to the flat orientation of the louvers, diffusion is predominant and control of the candlepower distribution is severely limited.

U.S. Pat. No. 4,621,309 Grawe discloses an elongated luminaire in which a set of parabolic louvers are positioned in a light fixture with upwardly inclined baffles or light guiding plates. The light guiding plates are intended to initially orient the rays of light passing through the grid from an above oriented light. This is to control light distribution through a bidirectional orientation so light is distributed in opposed angular directions from the substantially vertically oriented parabolic louvers. However, diffusion again creates a problem with this arrangement due to the flat nature of the light guiding plates.

Transparent louvers are shown in U.S. Pat. No. 4,368,504 to Sato et al. This patent discloses task lighting using a specially configured refractor member under a light. The refractor is intended to prevent "veiling" reflection on desk or other work surfaces. Again, the louvers are angularly oriented with the intent to control the distribution of light. However, the louvers are flat and diffusion again becomes a problem.

As may be seen from above, the need remains for a light distribution system in which the "cave effect" is effectively eliminated without increasing the wattage requirements for a given room and while maintaining a high lighting efficiency and through which low direct glare light is simultaneously distributed into the adjacent area.

BRIEF DESCRIPTION OF THE DRAWINGS

The preferred embodiment of the invention is illustrated in the accompanying drawings, in which:

FIG. 1 is a diagrammatic view of a prior art low direct glare parabolic luminaire and its light distribution curve for reducing glare and reflection;

FIG. 2 is a diagrammatic view illustrating the luminaire of FIG. 1 and the light distribution against an adjacent wall structure within a room, with the resulting "cave effect" shown along the upper portions of the wall;

FIG. 4 is a view illustrating the present grid structure with asymmetric candlepower distribution in two directions;

FIG. 6 is a view of a variation of the present grid in which one set of louvers is positioned to provide candlepower distribution curves on sides of the grid opposite to those shown in FIG. 3.

DETAILED DESCRIPTION OF THE PREFERRED EMBODIMENTS

Figure 3:
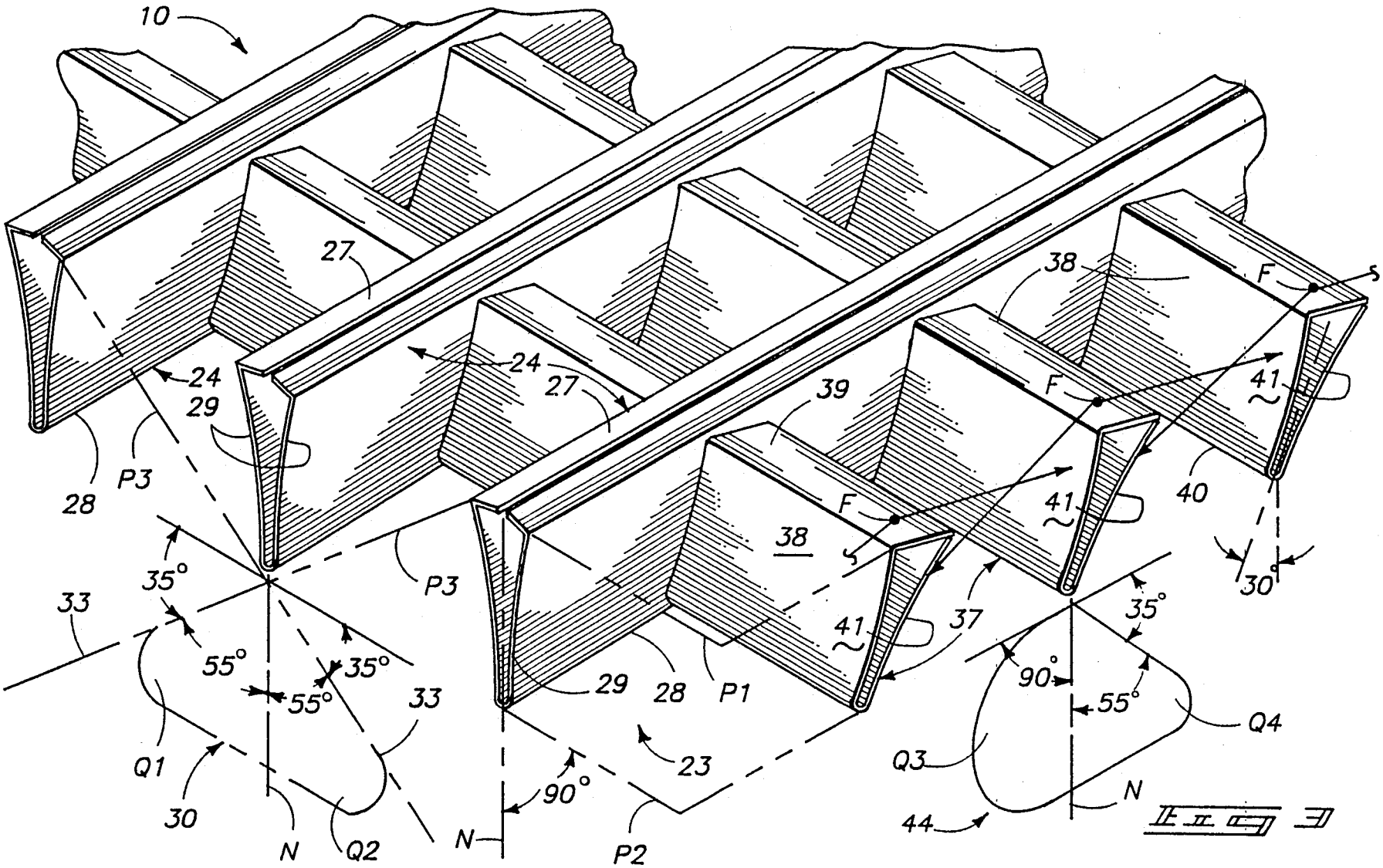
FIG. 3 is an isometric fragmented view of the present parabolic lighting grid showing with a symmetrical candlepower distribution curve on one side of the grid produced by a first set of louvers, and a asymmetric candlepower distribution curve on another side of the grid produced by a second set of louvers.
Figure 3:
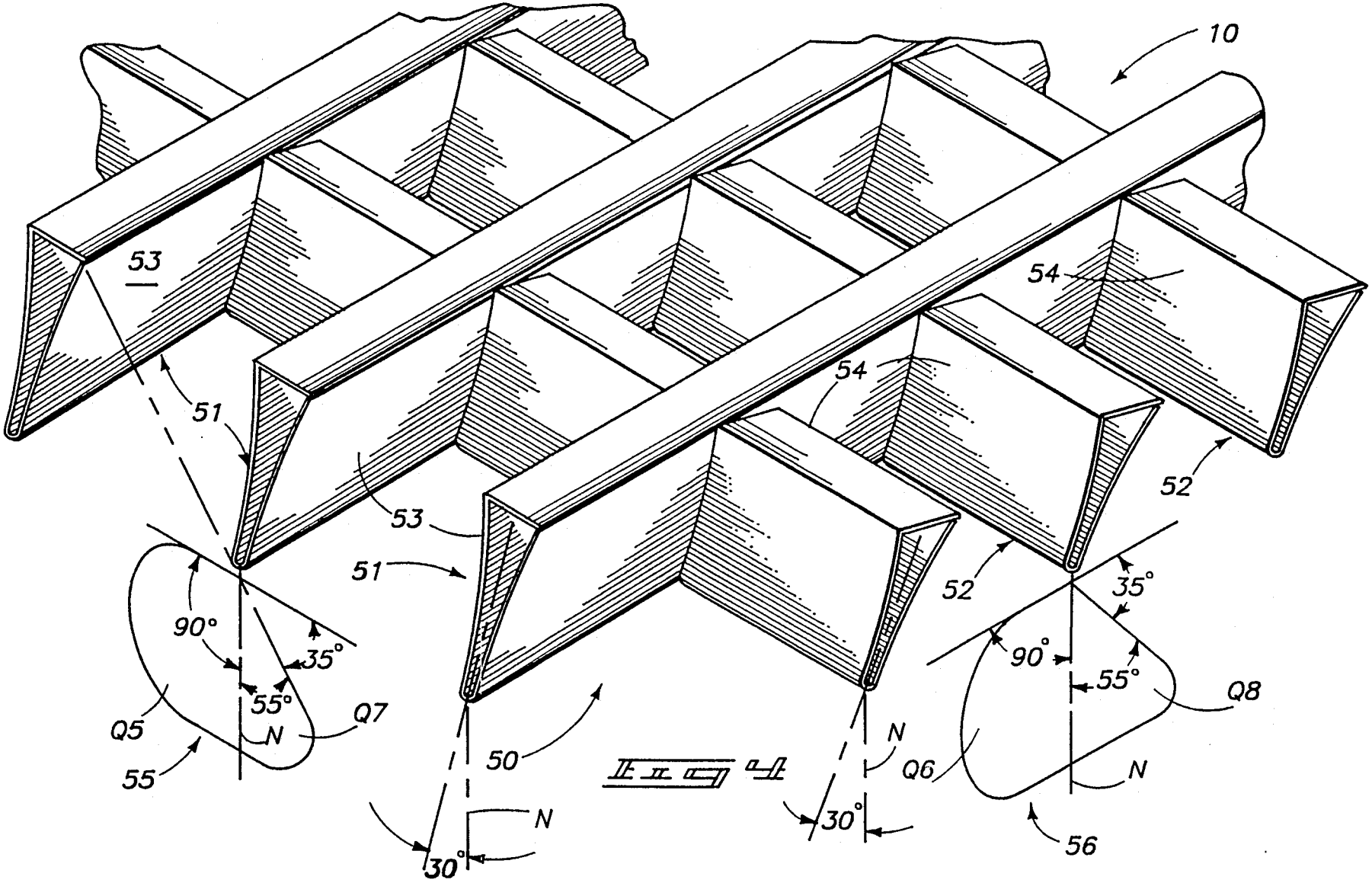

The following disclosure of the invention is submitted in futherance with the constitutional purpose of the Patent Laws "to promote the progress of science and useful arts" (Article 1, Section 8).

FIGS. 1 and 2 are illustrative of prior art lighting grids 11 and luminaires 12 in which light is controlled by parabolic louvers 13 arranged in a grid configuration and placed flush with a ceiling 14 (FIG. 2). Lights 15 are situated above the parabolic louvers 13 such that the light emitted therefrom is reflected by the typically specular surfaces 16 of the louvers 13. The grid shown produces a low direct glare lighting effect that has been effectively used to reduce fatigue and eye strain by eliminating or substantially reducing glare and reflection, especially on computer "VDT" screens.

The illustrated "low direct glare" grid confines light directed downwardly through the grid to a candlepower distribution curve 17 in a plane transverse to the elongated louvers and related to nadir in quadrants that, typically include cut off angles at approximately 55° from nadir N.

As used herein "nadire" N, is a reference line or axis that is perpendicular to the grid and vertical in relation to the room. In relation to the individual candlepower distribution curves described herein, nadir is a reference line or axis at the approximate center of the curve, dividing the curve in a plane transverse to the elongated louvers into two "quadrants". The "cut off angle" is the maximum angle from nadir at which light will pass through the grid from above.

FIG. 2 illustrates the "cave effect" problem that has been associated with prior art form of lighting grid 11. The low direct glare grid formation and the desired candlepower distribution curve of such grids, typically produces the "cave effect" (CE, FIG. 2). The "cave effect" is due to the relatively sharp cut off angles 18 of light through the coventional low direct glare parabolic grids.

The present invention not only will eliminate the shaded area identified as the "cave effect", but will additionally allow low direct glare light into the adjacent room without significant loss of efficiency or increased requirements for wattage.

Figure 5:
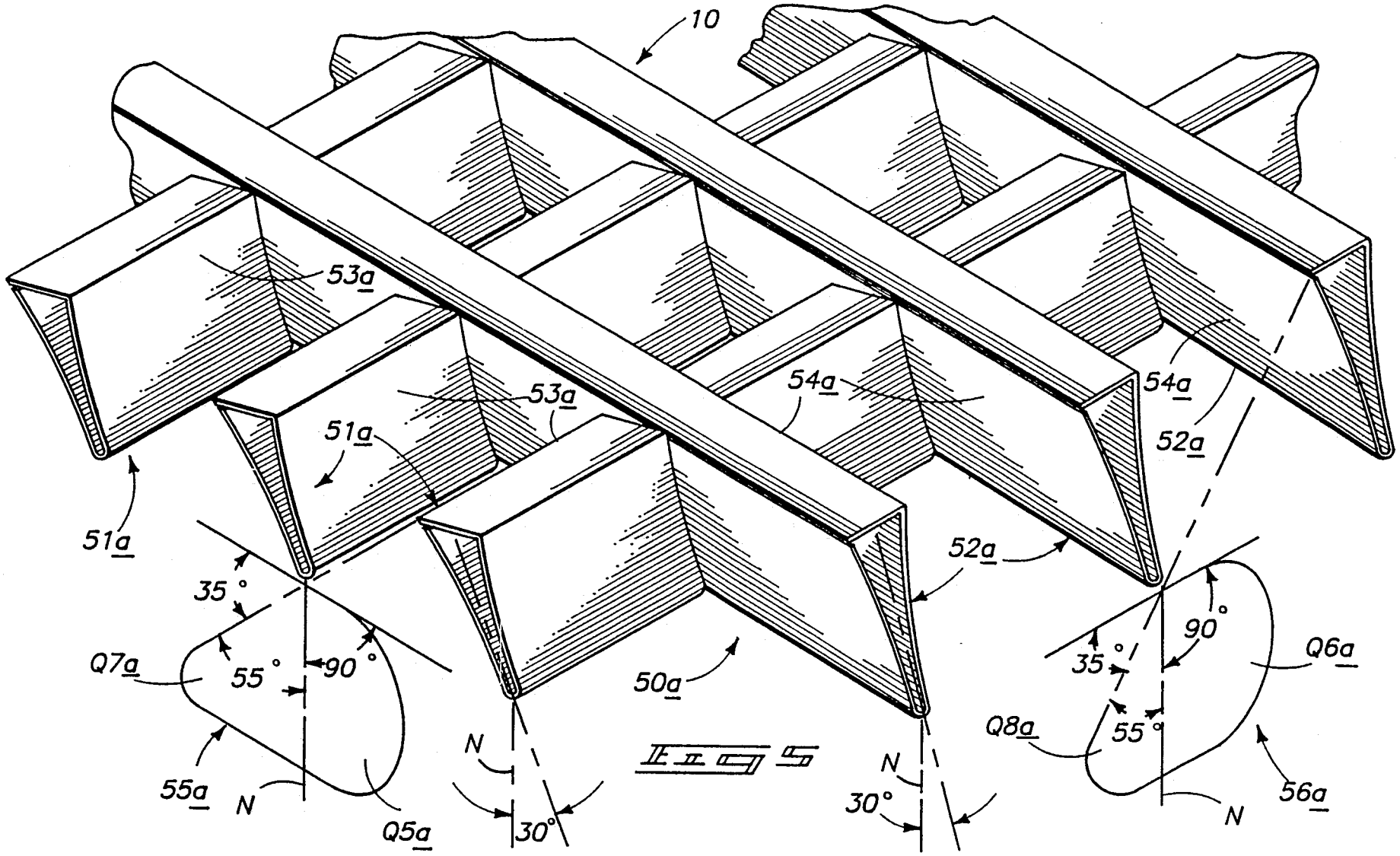
FIG. 5 is a fragmented pictorial view of a lighting grid with louvers arranged to produce asymmetrical distribution curves opposite to those shown in FIG. 4.
Figure 5:
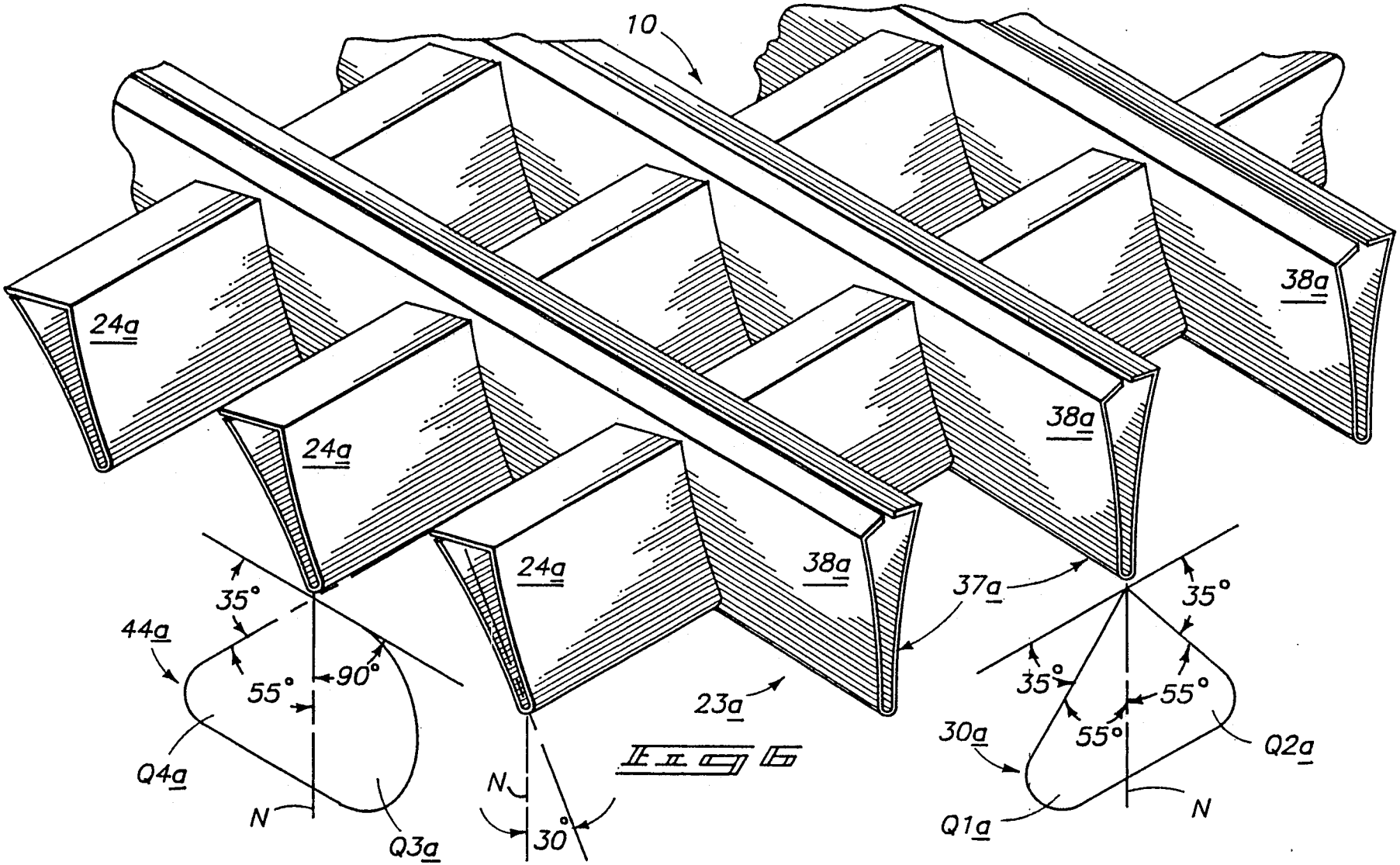

A first configuration of the present lighting grid 10 is shown in FIGS. 3. A reversed configuration is shown in FIG. 6. In other words, the louvers 24 of a first louver set 23 in FIG. 3 are oriented substantially vertically or at 0° from nadir N. Similar louvers shown at 24*a*, in FIG. 6, are angled approximately 30° from nadir N. Likewise, a second set of louvers 37 which are rotated approximately 30° in FIG. 3, are shown upright at 37*a* in FIG. 6. Other alterations in the angular relationships of the louvers are shown in FIGS. 4 and 5.

Referring again to FIG. 3, the first louver set 23 is shown, comprised of a selected number of individual elongated parabolic louvers 24. The elongated louvers 24 are oriented in parallel relation to one another and are spaced apart by equal distances. The louvers 24 include top ends 27 and bottom edges 28. The top ends 27 are situated within a plane P1 that is spaced above and substantially parallel to a parallel plane P2 passing through the bottom edges 28. The distance between the planes P1 and P2 is the thickness dimension of the grid.

The indivdual louvers 24 include opposed parabolic surfaces 29. It is advantageous that the surfaces 29 be specular. As such, the louvers 24, as with all other louvers used in all configurations of the present invention, are advantageously formed of sheet material such as aluminum with a reflective, polished or otherwise specular parabolic surfaces. The louvers could also be formed of other materials such as plastic and by other means, such as by injection molding.

Spacing of the louvers 24 is determined by the cut off angle desired for light passing from above the grid and through the grid from the top ends of the louvers to the bottom edges. Light rays, in intersecting planes designated by lines P3 in FIG. 3, pass downwardly from the light source (not shown) through the grid. Each plane P3 intersects the top end of one louver and the bottom edge of the adjacent louver. Planes P3 thus form the cut off angles 33 for the candlepower distribution curve 30. These angles are desirable for "low direct glare" light distribution to avoid glare and reflectance. Thus, the cut off angles 33 will be 45° to 70° from nadir and preferably approximately 55°.

The 55° low direct glare candlepower distribution curves 30 with quandrants Q1 and Q2 are similar to the quadrants shown in FIG. 1. The curve 30 lies in a plane tranverse to the lengths of the louvers 24 of the first louver set 23.

If the spacing of the louvers 24 is equal as preferred, and if the curvature of the parabolic surfaces 29 of the louvers 24 are also equal, the result is a uniform candlepower distribution curve for the entire grid in planes transverse to the louvers 24.

It is known to conform the parabolic curvature of the individual louvers 24 and selected louver spacing to more particularly define a desired candlepower distribution curve.

The principles of parabolic louvers and resulting light distribution effects are identified in U.S. Pat. No. 2,971,083 granted to D. R. Phillips et al. in 1961. Portions of that patent relating to the fuction of parabolic louvers, and the disclosure relating to exemplary forms of light grid frames and light elements are hereby incorporated by reference in the present application.

The second louver set 37 is comprised of a plurality of individual louvers 3ᵖ that are similar in dimension and parabolic curvature to louvers 24, but are rotated at prescribed angles from nadir. However, each louver 38 includes a top end 39 that is relatively flat compared to the top ends 27 of louvers 24. The flat top edges reduce reflectance of the louvers 38 at their rotated angles, thereby maximizing efficiency.

Each louver 38 also includes a bottom edge 40 that is rotated about a point along the upper end 39. The louvers 38 are elongated, parallel to one another, and intersect with the louvers of the first set 23.

The louvers 38 of the second set are advantageously spaced between the louvers 38 of the second set is substantially equal to the transverse spacing between the louvers 24 for the first set 23. Such spacing helps determine the light distribution curves for the second set.

The angle of rotation for the louvers 38 of second set 37 is between approximately 25° and 45° from nadir N, and is preferably approximately 30° from nadir N.

The above spatial and angular relationship for the louvers 38 is also the same for the other grid configuration described below and shown in FIGS. 4 and 5.

The second set 37 of louvers 38 are substantially rotated at their top ends 39 through equal angles of approximately 30° from Nadir N. The point or axis of rotation for each louver 38 is approximately the focus F (FIG. 3) of the facing parabolic curved surfaces 41 for the two adjacent louvers 38 to each side of the focus F (as identified by the arrows leading from the foci F in FIG. 3).

It has been found that with the above spacing and angular relationship, the louvers 38 will produce an asymmetrical light distribution curve 44 in a plane transverse to the elongated louvers 38. The curve includes a wall wash light distribution quadrant Q3 on one side with cut off angle at 90° from nadir, and a low direct glare distribution curve quadrant Q4 with a cut off angle at 55° to the opposite side of nadir.

With the above relationship, and with the low direct glare distribution curve of the intersecting first louver set 23, I am able to selectively position groups of the grid arrangement within a room to facilitate "washing" of adjacent walls with light to thereby eliminate the "cave effect". This is accomplished while simultaneously providing low direct glare light distribution into the room for desired lighting effects using the same grid and without loss of lighting efficiency.

The grid configuration 23*a* of FIG. 6 is similar to that of FIG. 3 with the exception that the angles of its louvers 24*a* and 38*a* are reversed from the angles of louvers 24, 38 shown in FIG. 3. Thus, candlepower distribution curves 30*a* and 44*a* for the grid configuration 23*a* are likewise reversed.

A symmetrical low direct glare curve 30*a*, including equal opposed quandrants Q1*a* and Q1*b* are provided by the louvers 38*a*. Curve 30*a* is equivalent to curves 30 of the FIG. 3 version.

An asymmetrical curve 44*a* is produced by louvers 24*a* and includes a low direct glare quadrant Q4*a* and a wall wash quadrant Q3*a*. Curve 44*a* is substantially the mirror image equivalent to the curve 44 of the FIG. 3 version.

Both sets of louvers 51, 52, and 51*a*, 52*a* for each of the respective lighting grid configurations 50, 50*a* shown in FIGS. 4 and 5 include the louver spacing and angles for the second louver set 37 described above. The intersecting angled louver sets 51, 52, and 51*a*, 52*a* form grids 50, 50*a* that provide effective wall washing light to corners C (FIG. 7) and low direct glare light distribution into the room interior.

The louvers 53, 54, and 53*a*, 54*a* are angled approximately 30° from nadir in both sets. The spacing and angular orientation of the louvers in each set is such that the associated candlepower light distribution curves 55, 56 and 55*a*, 56*a* (substantially identical to the curve 44 and mirror images thereof) are oriented with asymmetric wall washing quadrants Q5, Q6 and Q5*a*, Q6*a* for the room corners. Low direct glare direct glare distribution curve quadrants Q7, Q8 and Q7*a*, Q8*a* are directed toward the interior of a room.

The louvers of grid 50 (FIG. 4) are oriented to provide wall washing and low direct glare distribution curves for room corners opposite to the corners affected by the grid 50*a* (FIG. 5).

Figure 7:
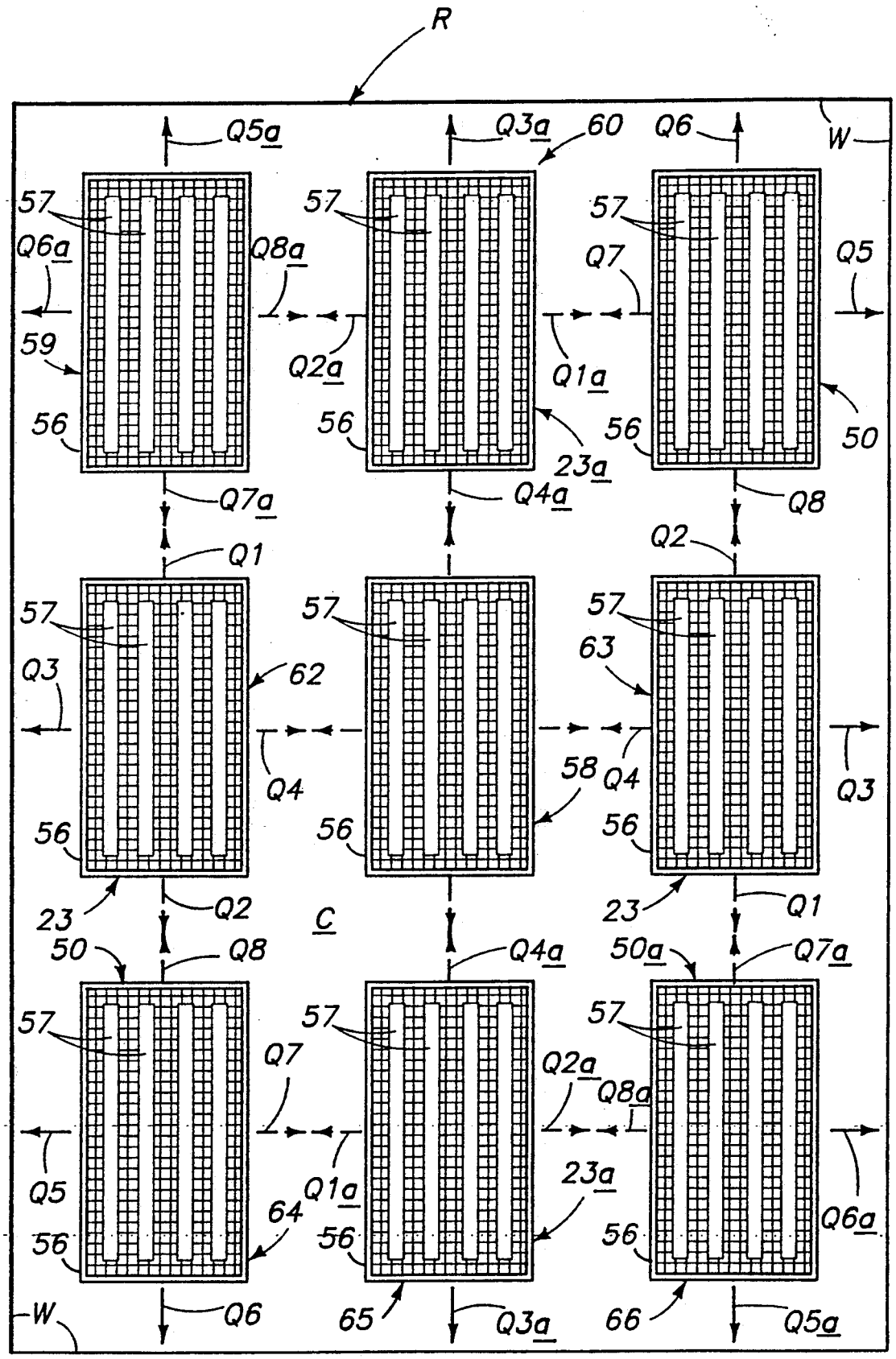
FIG. 7 is a diagrammatic plan view of a illumination system using the present lighting grid arrangements shown in FIGS. 3–6 to provide even light distribution throughout the room and wall washing characteristics to eliminate the "cave effect".

The above desired grid configurations are schematically identified in FIG. 7, which is illustrates a system of the present novel grids to provide both low direct glare lighting within a room R while simultaneously providing wall wash illumination to eliminate the "cave effect" against walls W.

The grid configurations shown in FIGS. 3–6 are used in the FIG. 7 room diagram, with solid line arrows corresponding diagrammatically to the respective wall wash quadrants of the candlepower distribution curves for the various grid arrangements. The respective low glare distribution quadrants are indicated by dashed arrows.

The various grids are shown mounted to the room ceiling C through conventional recessed frames 56, to direct light from overhead light bulbs or tubes 57 mounted within the frames 56.

The central lighting grid 58 in the diagram may be a conventional prior art type lighting grid arrangement whereby low direct glare light distribution will exist in both planes perpendicular to the two sets of elongated louvers making up the grid. Thus, the center grid 58 will spread the light including, if desired, conventional (see FIG. 1) symmetrical candlepower distribution curves in planes both transverse to and parallel with the associated light tube (if florescent is used). This cone of light will be overlapped by the low direct glare quadrants from the surrounding novel grids.

The top left grid shown at 59 and the bottom right grid at 66 make use of the grid configuration shown in FIG. 5. The same grid configuration is simply rotated 180° between the top left and lower right corners of the room upon installation. Thus, the wall wash quadrants Q5*a* and Q6*a* produced by the inclined louvers of these grids will be directed to both walls and into the top left and lower right corners. The low direct glare distribution curve quadrants Q7*a* and Q8*a* from these grids will project into the room and along lower portions of the wall W to overlap lighting from adjacent grids in a normal fashion.

The top center 60 and bottom center 65 grids are also identical and may be configured as shown in FIG. 6. One set of the louvers in each grid 60, 65 are angled while the other set is upright as described above. The grids are arranged with their inclined louvers are oriented toward the wall with the wall washing quadrants Q3*a* of the asymmetrical candlepower distribution curves toward the wall to eliminate any shadows or "cave effect". Quadrants Q4*a* are directed to the center of the room for low direct glare lighting. The upright elongated louvers of grids 60, 65 provide symmetrical low direct glare light distribution curve quadrants Q1*a* and Q2*a* directed along the wall to overlap light from adjacent grids. The top right grid 61 and bottom left grid 64 may take the configuration of the grid louver orientation 50 shown in FIG. 4. This orientation is similar but reversed from the angular orientation of the louver shown in FIG. 5 in order to accommodate the opposed corners. Thus, the wall washing quadrants Q5 and Q6 of the distribution curves are directed toward the adjacent walls and corner as indicated by the arrows in FIG. 7. The low direct glare quadrants Q7 and Q8 are directed along the adjacent walls and into the room.

The center left grid 62 and center right grid 63 may be formed in the configuration shown in FIG. 3. This configuration is somewhat similar to the FIG. 6 configuration except that the orientation of the louvers in the two sets has been reversed. The longitudinal louvers here have been angularly inclined while the transverse louvers in the FIG. 6 configuration were inclined. This is a relatively small difference in construction of the grid and simply reflects a difference in the overall rectangular grid configuration in consideration of the louver angles. Thus, the angularly inclined louvers in the configuration of FIG. 6 will direct wall washing light distribution quadrants Q3 outwardly against the adjacent wall while the low direct angle distribution curve quadrants Q1, Q2, and Q4 are directed along the wall and inwardly to overlap light distribution from the corner grids and the central grid 58.

The nine grids shown in FIG. 7 represent a substantially conventional array for a standard room. It should be understood that more or fewer lighting grids may be provided.

For example, as few as four grids may be provided to illuminate a smaller room, with full utilization of the effects produced by the present grid system. In such a situation, the grids shown in the corners in FIG. 7 would be used and the remaining grids would be eliminated. Larger rooms could require many more of all the various grid configuration, depending upon the room size and geometry.

From the above description it may be understood that the light emitting from the present grid system in the wall wash quadrants will be directed substantially horizontally along the ceiling surface (at 90° to nadir) to completely wash the adjacent wall in light and thereby eliminate the "cave effect". Simultaneously, light in the low direct glare quadrants is directed into the room for use. Thus, the user is benefitted by the elimination of the unsightly "cave effect" while a normal, low direct glare light distribution arrangement is provided for the remainder of the room. This is done with the available wattage for providing useful light to the room and its occupants and without requiring additional wattage and fixtures to eliminate the cave effect.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

What is claimed is:

1. A lighting system for a room having a ceiling and a wall, the lighting system comprising:

a light;

a light grid;

a frame mounting the light grid to the ceiling below the light so light therefrom will pass through the grid;

wherein the light grid is comprised of intersecting first and second sets of parallel elongated parabolic louvers;

wherein the louvers of at least one of the first or second sets are angularly oriented to nadir and spaced apart to confine light passing downwardly therethrough to an asymmetrical candlepower distribution curve, including a wall washing quadrant on one side thereof and a low direct glare distribution quadrant including a cut off angle of approximately 45 to 70 degrees from nadir on an opposite side thereof; and wherein the light and light grid are placed adjacent the wall such that the wall washing quadrant is oriented toward the wall to illuminate the wall to the ceiling.

2. A lighting grid, comprising:

a first set of elongated, parallel, and spaced apart light reflective parabolic louvers angularly set in relation to nadir such that light passing therethrough from above is confined below the louvers within a substantially symmetric low direct glare candlepower distribution curve in a plane transverse to the louvers;

a second set of elongated, parallel, and spaced apart light reflective parabolic louvers intersecting the first set of louvers and forming an open grid therewith; and wherein the second set of louvers are angled relative to nadir, to produce an asymmetric candlepower distribution curve including a low direct glare curve quadrant including a cut off angle of approximately 45 to 70 degrees from nadir to one side of nadir and a wall wash curve quadrant to an opposite side of nadir in a plane perpendicular to the second set of louvers.

3. The lighting grid of claim 2, wherein the wall wash curve quadrant includes a cut off angle at approximately 90 degrees from nadir.

4. The lighting grid of claim 2, wherein the low direct glare curve quadrant includes a cut off angle at approximately 55 degrees from nadir and wherein the wall wash curve quadrant includes a cut off angle at approximately 90 degrees from nadir.

5. The lighting grid of claim 2, wherein the louvers are substantially specular.

6. The lighting grid of claim 2, wherein the second set of louvers are angled at between approximately 25 and 45 degrees to nadir.

7. The lighting grid of claim 2, wherein the first set of louvers are angled at approximately 0 degrees to nadir and the second set of louvers are angled at approximately 30 degrees to nadir.

8. The lighting grid of claim 2, wherein the spacing between adjacent louvers in the first and second sets is equal.

9. The lighting grid of claim 2, wherein the louvers of the first set include upper ends and opposed bottom edges, and wherein the louvers of the first set are spaced apart from one another so that a plane intersecting the upper end of one louver and the bottom edge of an adjacent louver defines a cut-off angle between adjacent louvers between approximately 45 and 70 degrees from nadir.

10. A lighting grid. comprising:

a first set of parallel, spaced apart, and elongated light reflective parabolic louvers angularly set in relation to nadir such that light passing therethrough from above is substantially confined in a first plane transverse to the first set of louvers within a first asymmetric candlepower distribution curve including a low direct glare curve quadrant including a cut off angle of approximately 45 to 70 degrees from nadir to one side of nadir and a wall wash curve quadrant to an opposite side of nadir;

a second set of parallel, spaced apart, and elongated light reflective parabolic louvers, intersecting the first set of louvers and forming a grid therewith; and wherein the second set of louvers are spaced apart and angularly set in relation to nadir such that light passing therethrough from above is substantially confined in a second plane transverse to the second set of louvers within a second asymmetric candlepower distribution curve including a low direct glare curve quadrant including a cut off of angle of approximately 45 to 70 degrees from nadir to one side of nadir and a wall wash curve quadrant to an opposite side of nadir.

11. The lighting grid of claim 10, wherein the first and second sets of louvers are each angled at approximately 30 degrees to nadir.

12. The lighting grid of claim 10, wherein the spacing between adjacent louvers in the first and second sets is equal.

13. The lighting grid of claim 10, wherein the wall wash curve quadrants are similar, each including a cut off angle at approximately 90 degrees from nadir.

14. The lighting grid of claim 10, wherein the low direct glare curve quadrants of the first and second sets of louvers each includes a cut off angle at approximately 55 degrees from nadir and wherein each wall wash curve quadrant includes a cut off angle at approximately 90 degrees from nadir.

15. The lighting grid of claim 10, wherein the louvers are substantially specular.

* * * * *